US007017796B2

(12) United States Patent
Ishikawa

(10) Patent No.: US 7,017,796 B2
(45) Date of Patent: Mar. 28, 2006

(54) METHOD OF MANUFACTURING PAPER PACKAGING CONTAINER AND PAPER PACKAGING CONTAINER

(75) Inventor: Toru Ishikawa, Tokyo (JP)

(73) Assignee: Tetra Laval Holdings & Finance S.A., Pully (CH)

( * ) Notice: Subject to any disclaimer, the term of this patent is extended or adjusted under 35 U.S.C. 154(b) by 42 days.

(21) Appl. No.: 10/343,440

(22) PCT Filed: Jul. 30, 2001

(86) PCT No.: PCT/JP01/06519

§ 371 (c)(1),
(2), (4) Date: Jul. 22, 2003

(87) PCT Pub. No.: WO02/10020

PCT Pub. Date: Feb. 7, 2002

(65) Prior Publication Data

US 2004/0011688 A1 Jan. 22, 2004

(30) Foreign Application Priority Data

Jul. 31, 2000 (JP) ..... 2000-231448

(51) Int. Cl.
*B65D 43/00* (2006.01)
*B65B 43/10* (2006.01)
*B31B 1/50* (2006.01)

(52) U.S. Cl. ..... 229/125.15; 53/455; 53/456; 53/458; 53/469; 229/125.14; 493/87; 493/184

(58) Field of Classification Search ..... 229/125.42, 229/125.14–15, 110, 123.2, 137; 53/452, 53/455–459, 467–469; 493/87, 93, 183–184, 493/164

See application file for complete search history.

(56) References Cited

U.S. PATENT DOCUMENTS

| | | | | |
|---|---|---|---|---|
| 3,785,111 | A * | 1/1974 | Pike | 53/451 |
| 3,855,907 | A * | 12/1974 | Johnson et al. | 53/469 |
| 4,580,392 | A | 4/1986 | Lagerstedt et al. | |
| 5,537,803 | A * | 7/1996 | Olsen | 53/467 |
| 6,048,295 | A * | 4/2000 | Olsen | 493/184 |
| 6,357,203 | B1 * | 3/2002 | Cicha et al. | 493/184 |
| 6,402,019 | B1 * | 6/2002 | Casale | 229/123.2 |
| 6,430,899 | B1 * | 8/2002 | Cicha | 53/477 |

FOREIGN PATENT DOCUMENTS

| | | | |
|---|---|---|---|
| JP | 58-193206 | A | 11/1983 |
| JP | 4-53602 | A | 2/1992 |
| JP | 11-91792 | A | 4/1999 |
| JP | 11-236027 | A | 8/1999 |
| JP | 11-310230 | A | 11/1999 |

* cited by examiner

*Primary Examiner*—Byron P. Gehman
(74) *Attorney, Agent, or Firm*—Buchanan Ingersoll

(57) ABSTRACT

A paper packaging container is obtained by tube forming with a longitudinal seal of web-shaped packaging material. The package is filled with liquid food, and a transverse seal of the tube packaging material is made to form a pillow-shaped preliminary shape container. The preliminary shape container is then cut, and a final shape container having a top, side walls and a bottom is formed by folding the packaging material along crease lines. Flaps are formed during the forming of the top of the container and are folded outwardly and downwardly onto side wall faces of the container. The top of the container is formed as a shed roof shape. The method of folding the flaps outwardly from the top of the container and the resulting shaped container allows attachment of a large spout with a wide mouth on the top, while achieving high speed manufacturability without subjecting the paper packaging material to high stresses.

20 Claims, 7 Drawing Sheets

METHOD OF MANUFACTURING PAPER PACKAGING CONTAINER AND PAPER PACKAGING CONTAINER

FIELD

This invention relates to a method of manufacturing a paper packaging container and the paper packaging container.

BACKGROUND

Flexible packaging laminated material has been used to pack liquid food for many years. A packaging container for use with milk, juice, refined sake, shochu, mineral water and other drinks is produced by: forming web-like packaging laminated material of, for example, a fibrous substrate (for example, paper)/plastic laminate, which has crease lines, into a tube shape having a longitudinal seal, as shown in FIG. 5; filling the tube-shape formed packaging material with contents; sealing the tube packaging material transversely; forming the packaging material into a cushion-like or pillow-like preliminary container; cutting the containers individually at a fixed distance in the case of the web-shaped packaging material; and folding a container corner flap along the crease lines to form a brick-shaped container. The container includes panels 3 for side walls, as shown in FIG. 4, a longitudinal seal 5, a transverse seal 6, a panel 4*a* forming a top wall, and flaps 8 (the corner flaps are formed when a top and bottom are formed) sealed at the side walls. As an example, a material for the fibrous substrate can be cardboard.

A gable-top paper packaging container is provided by: cutting a paper packaging material in the predetermined shape; forming blanks that are sealed in a lengthwise direction to form containers; sealing the bottom of the blanks in a filling machine; filling the formed blanks with contents of milk, juice or other drinks from an upper opening; and sealing the upper part of the containers. With these packaging materials, an appearance design of the packaging container product can be printed on the surface.

Crease lines for each container are repeatedly and continuously added to the web-shaped packaging material. FIG. 5 shows packaging material for one container. In the packaging material 1 for one container, the web-shaped packaging material having crease lines comprises a seal region 5 for forming the longitudinal seal, transverse seal regions 6 for forming a seal in a transverse direction of tube packaging material, side panels 3 that form container side walls, panels 4*a* for forming a top of the container, panels 4*b* and 4*c*, which are folded to form flaps 8, and are welded to the side walls or to a bottom of the container. Crease lines 7*a*–7*c* are formed at the boundaries of these panels.

In the brick-shaped container as shown in FIG. 4, transverse seal part 6 and longitudinal seal part 5 occupy the middle of the container top. Accordingly, the blank space available for applying a spout, an opening device, a lid and/or a plug is insufficient. As a result, only a comparatively small spout can be applied with a container formed in this way.

Furthermore, the sharpened four corners of the container top are points where a container is most likely to receive damage by means of a physical mechanical external effect, such as during a distribution process.

Gable top-shaped paper packaging containers, wherein the paper containers have a wide top part with an applied large-scale spout, have been proposed. (Japanese Patent Laid-Open No. 11-91792 and Japanese Patent Laid-Open No. 11-236027). However, in these containers the folding part is folded tightly toward the inside of the package by folding of the top seal fin when the shed roof shape of one sheet roof is formed from the gable top shape. This method of forming the container results in increased stresses to the packaging material as a result of the compression and tension exerted during the forming process. The strength characteristics of the resulting paper container are therefore deteriorated remarkably.

Furthermore, because it is difficult to fold a container material along the crease lines, when the asymmetric gable top shape paper packaging container is formed, a preliminary top fold formation apparatus for the paper container is proposed (Japanese Utility Model Laid-Open No. 4-53602).

However, in existing high speed packaging filling machines producing, for example, 6,000 to 15,000 containers an hour, it is difficult to interpose the tool in a container interior and to fold along the crease lines, by using the proposed preliminary fold formation apparatus.

SUMMARY

A container and a method of manufacturing the container according to one embodiment provides a wide space on a top of the paper container, and a comparatively large-scale spout and opening device.

The container and container manufacturing method reduce any container damage by means of reduction of a mechanical physical external effect in a distribution process at the four corners of the container top.

The container and container manufacturing method also provide for a container having good strength characteristics by forming the paper packaging container without any tight folding of parts of the packaging laminated material, and without subjecting the container to a lot of tension and compression by the pushing, folding and forming of the container.

The manufacturing method according to an embodiment also forms a container at high speed with folding along crease lines in existing packaging filling machines, producing the containers without using any special preliminary top crease formation apparatus.

A method of manufacturing a paper packaging container in accordance with an embodiment comprises forming a web-shaped packaging material having crease lines into a tube with a longitudinal seal, filling contents in the tube-formed packaging material, forming the tube packaging material as a pillow-shaped preliminary shape container with a transverse seal in a transverse direction, cutting an individual preliminary shape container, and forming a final shape container having a top, side walls and a bottom by means of folding along the crease lines. In the top forming step, the body part of the preliminary shape container is pushed to inflate the part for the top and to fold the preliminary shape container along the crease lines. Along an axis of the slanted top ridgeline, flaps are formed by the top forming process, and are folded on the side wall faces to form the top as a shed roof shape.

A paper packaging container is obtained by tube forming with a longitudinal seal of a web-shaped packaging material, filling of contents into the tube-shaped packaging material, transverse sealing of the tube packaging material in a transverse direction, forming of pillow-shaped preliminary shape containers, cutting individual preliminary pillow-shaped containers, forming of a final shape container having a top, side walls and a bottom by folding along crease lines, and forming of flaps from the top of the container that are folded on side wall faces, with the top being formed as a shed roof shape.

In preferred embodiment of this invention, the paper packaging container has a spout on the top, with the top being slanted at an angle greater than 90 degrees relative to the front of the container, thereby having a shed roof shape.

DETAILED DESCRIPTION

Figure 1:
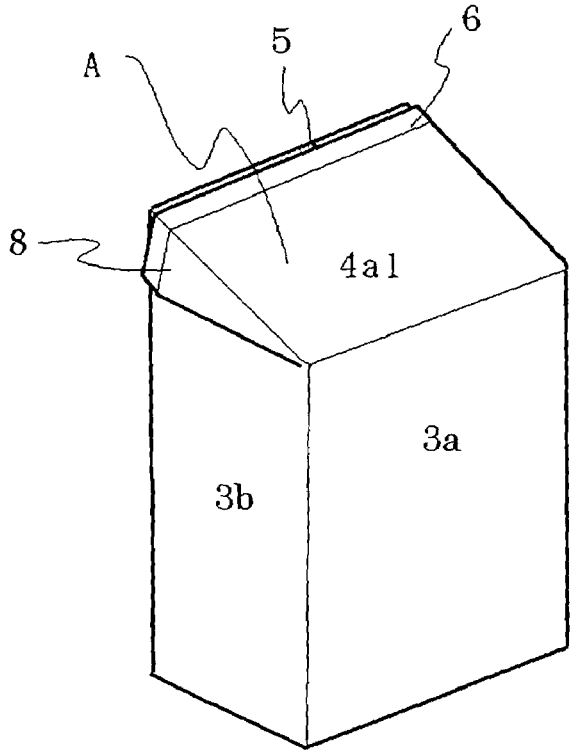
FIG. 1 is a perspective view showing one embodiment of the paper packaging container.

Referring initially to FIG. 1, a paper packaging container comprises a longitudinal seal 5 along the back side. A transverse seal 6 is folded along the back of the upper side, flaps 8 from the forming of the upper side are folded onto the side wall face of side panel 3*b* and held by means of adhesion, and a shed roof shape A is formed with a top panel 4*a*1 and the folded transverse seal 6. In this embodiment, the front panel 3*a* and top panel 4*a*1 are formed by folding along a crease line, with the angle between the front panel 3*a* and top panel 4*a*1 being greater than 90 degrees.

Figure 2:
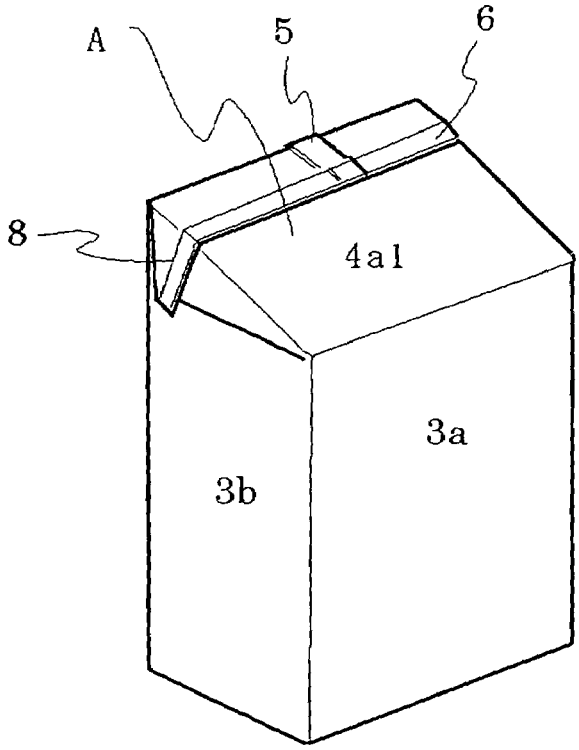
FIG. 2 is a perspective view showing another embodiment of the paper packaging container.

FIG. 2 is a perspective view showing another embodiment of the paper packaging container. The paper packaging container shown in FIG. 2 comprises a longitudinal seal 5, the same as in the embodiment of FIG. 1. The transverse seal 6 is folded along a forward portion of the upper side, with flaps 8 from the forming of the top side being folded onto a side wall face of side panel 3*b* and held by means of adhesion, and a shed roof shape A being formed from the top panel 4*a*1 with the folded transverse seal 6. The front panel 3*a* and top panel 4*a*1 are formed by folding along a crease line, with the angle between the front panel 3*a* and top panel 4*a*1 being greater than 90 degrees to form the shed roof shape A.

Figure 3:
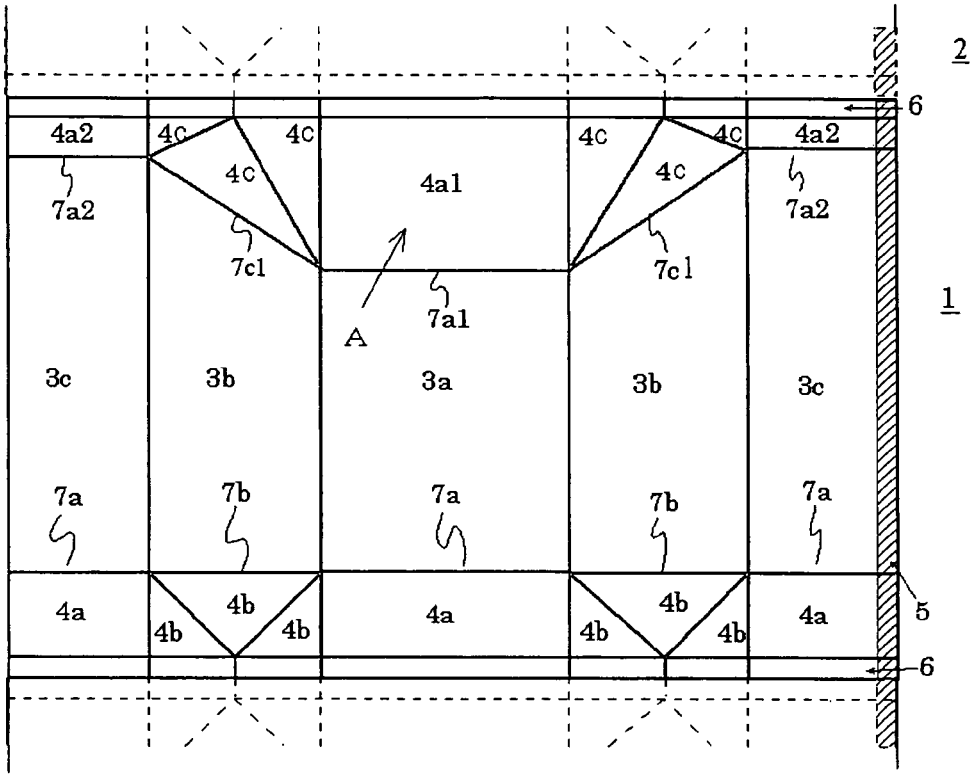
FIG. 3 is an outline development view of one embodiment of the paper packaging container.
Figure 4:
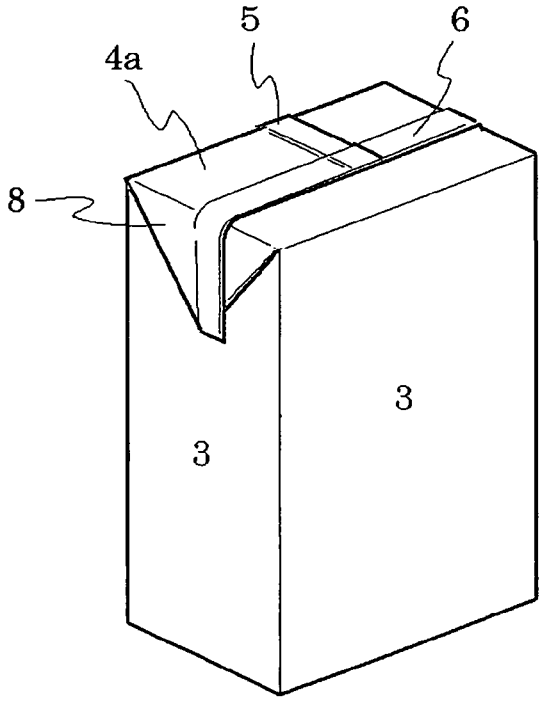
Fig. 4 PRIOR ART
FIG. 4 is a perspective view showing a conventional paper packaging container.
Figure 5:
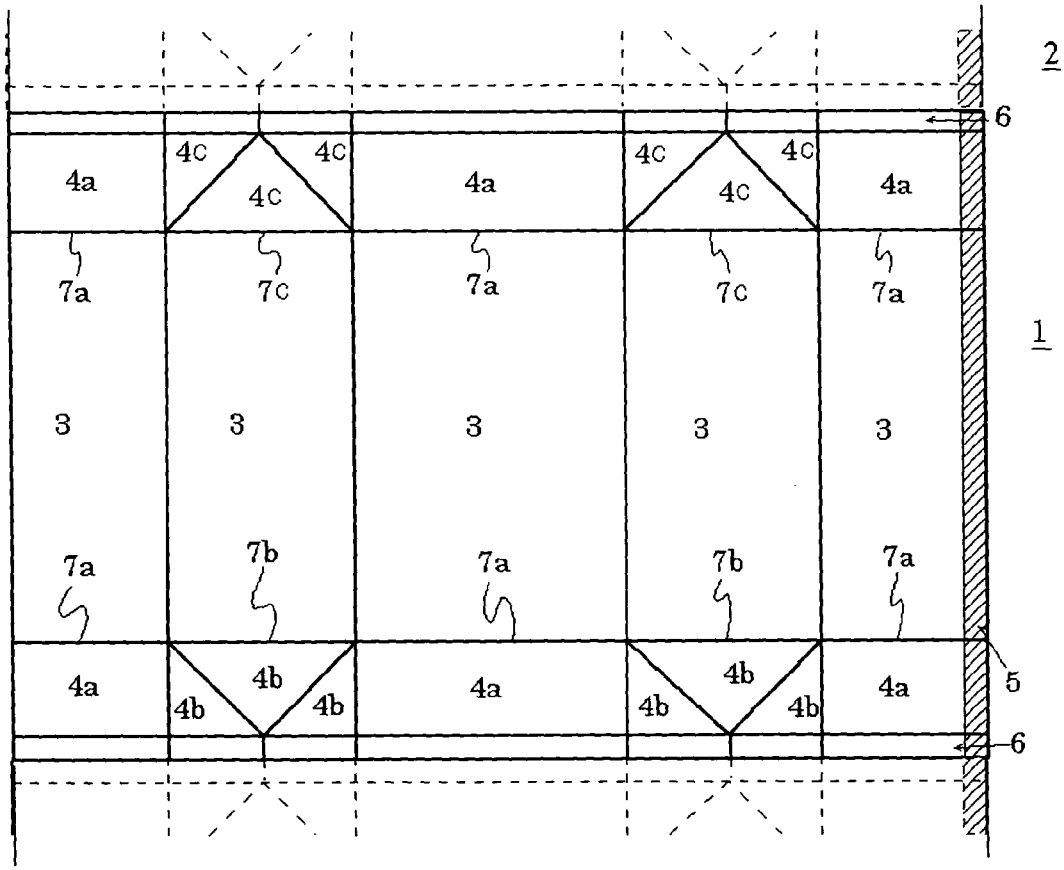
FIG. 5 is an outline development view of a conventional paper packaging container.

FIG. 3 is an outline development view of the web-shaped packaging material for the embodiment of the paper packaging container shown in FIGS. 1 and 2. As shown in FIG. 3, packaging material 1 for one container is immediately adjacent packaging material 2 for another container, and is formed with the creases in the web-shaped packaging material extending continually from one container to the next.

This packaging material includes a seal region 5 for the longitudinal seal of the containers provided along an edge of the packaging material, extending in a longitudinal direction of the packaging material. Transverse seal regions 6 for transverse seals are provided at the adjacent front and back edges of each section of packaging material, and extend in a transverse direction of the tube packaging material. Side wall panels 3 form container walls (front 3*a*, sides 3*b*, rear face 3*c*), panels 4*a*1, 4*a*2 form a top of the container, and panels 4*c* and 4*b* form flaps 8 that are sealed on side walls of the container or a bottom of the container, respectively, by folding and adhesion. Crease lines 7*a*1, 7*a*2, 7*c*1, 7*a*, 7*b* and 7*c* are formed at boundaries of the panels.

In one embodiment, the front panel 3*a*, the side panels 3*b* and the rear face panels 3*c* are located along a substantially equivalent line at their bottom side, with the height of the front panel 3*a* being lower than height of the rear face panel 3*c*, and upward crease line 7 *c*1 of side panel 3*b* forming a line that joins crease line 7*a*1, corresponding to adjacent front panel 3*a*, and crease line 7*a*2, corresponding to adjacent rear face panel 3*c*.

Figure 6:
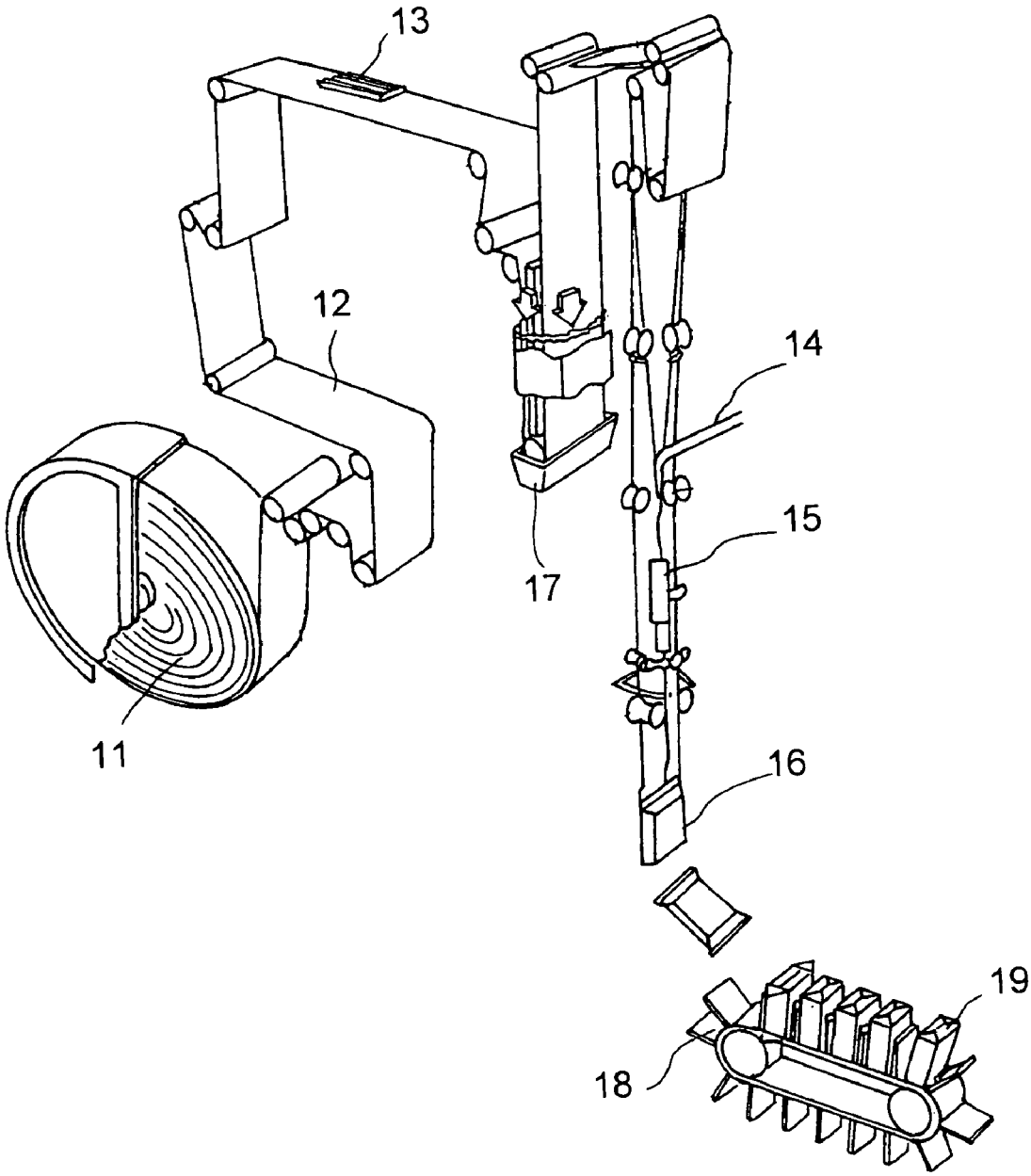
FIG. 6 is a perspective view of the packaging filling system which can be employed in a method of producing the paper packaging container according to an embodiment of the invention.
Figure 11:
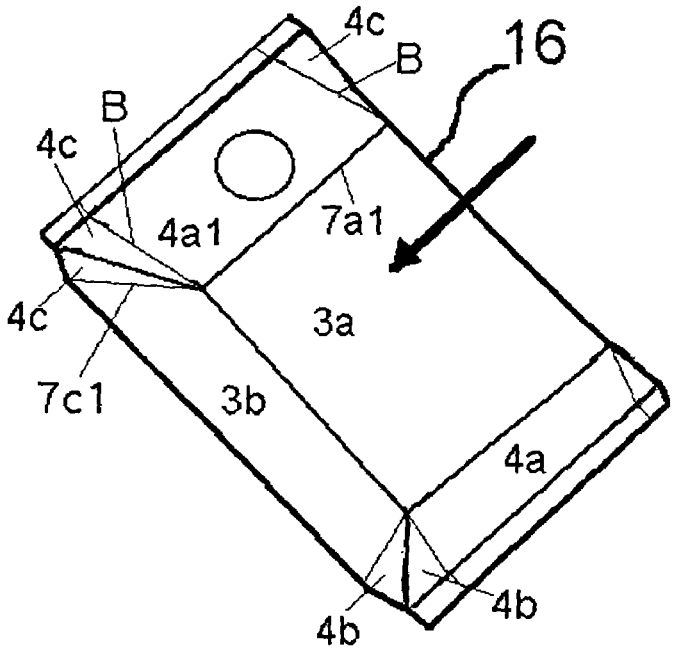
FIG. 11 is a perspective view of a preliminary shape container illustrating a folding step along crease lines of a preliminary shape container in a method of producing an embodiment of the container.

Referring to FIG. 6, a schematic perspective view of the packaging filling system is shown. FIG. 11 illustrates the folding step along the crease lines of a preliminary shape container. In a manufacturing method for this embodiment of a paper packaging container; the web-shaped packaging material 12 having crease lines is fed from a web-shaped packaging material roll 11. A strip tape for forming the longitudinal seal is attached along the web-shaped packaging material edge by an applicator 13. The packaging material is sterilized in a sterilization bath 17, and the web-shaped packaging material is formed into a tube by a longitudinal seal apparatus 15. Liquid food contents are filled into the tube-shaped packaging material from a filling pipe 14. A transverse seal of the tube packaging material forms a preliminary pillow-shaped container 16. Each individual preliminary shape container is cut, and transferred to a carrier device 18 where each of the containers is folded along the crease lines by folding apparatus (not shown) to form a final shape container 19 having a top, side walls and a bottom. In the example shown in FIG. 6, the containers are transported upside down.

In the top forming step of the embodiment shown in FIG. 11, a body part of the preliminary shape container 16 is pushed in as shown with an arrow, and a part that forms the top is inflated, or expanded outwardly as a result. The outwardly expanding forces on the top of the container allow the preliminary shape container to folded along the crease lines without the requirement of large compression and/or tension forces. The pushing step illustrated in FIG. 11 can be timed to occur before either the bottom or the top of the container have been formed, as shown in FIG. 11, or timed to occur after folding the bottom by folding panels 4*b* over the bottom panel 4*a*.

In the top forming, flaps 8 comprising three pieces of triangular panel 4*c* are folded outwardly and downwardly onto side wall faces 3*b* along the axes of the slanted top ridgelines B shown in FIG. 11, and the top is formed as a shed roof shape A.

In the bottom forming of this embodiment, flaps comprising three pieces of triangular panel 4*b* are folded onto bottom face 4*a* along the axes of bottom ridgelines.

Figure 7:
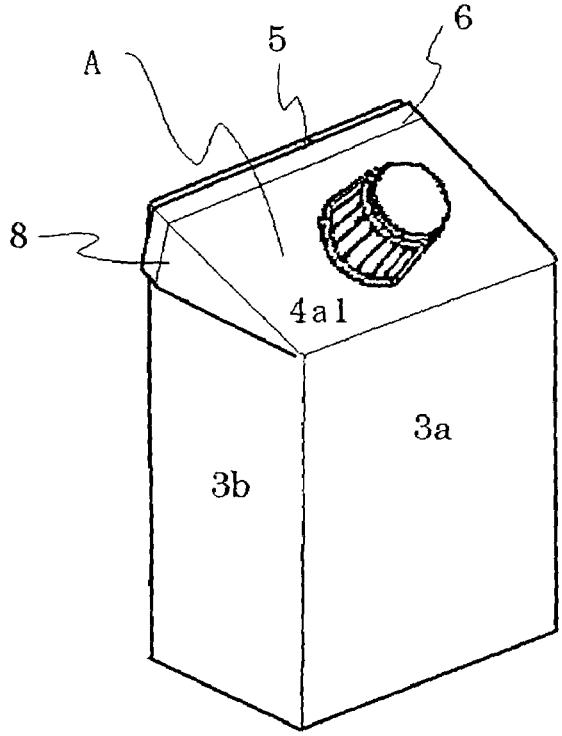
FIG. 7 is a perspective view which shows an embodiment of the container with an attached, large-sized screw cap.

Embodiments of paper packaging containers having a large-scale spout in the top are shown in FIGS. 7–10. FIG. 7 shows the container example with a large-sized screw cap in the paper packaging container example of FIG. 1. A container of the embodiment comprises the longitudinal seal 5. The transverse seal 6 is folded into the back edge of the upper side.

Figure 8:
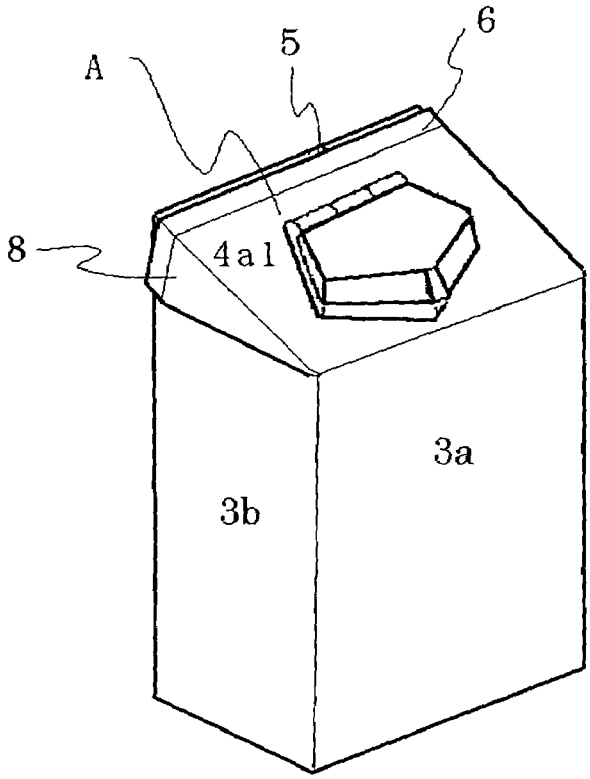
FIG. 8 is a perspective view which shows an embodiment of the container having a large-scale opening and shutting type cap.

Flaps 8 formed from panels 4*c* are formed during the top forming, and are folded onto side wall faces of the side panel 3*b*. The shed roof shape A is formed from the top panel 4*a*1 and the transverse seal 6. The large-sized screw cap is attached to the top panel 4*a*1. FIG. 8 shows a container example with a large-scale opening and shutting type cap attached to the paper packaging container example of FIG. 1. The amount of open space on the shed roof shape A allows for an opening and shutting type cap rather than a screw-type cap.

Figure 9:
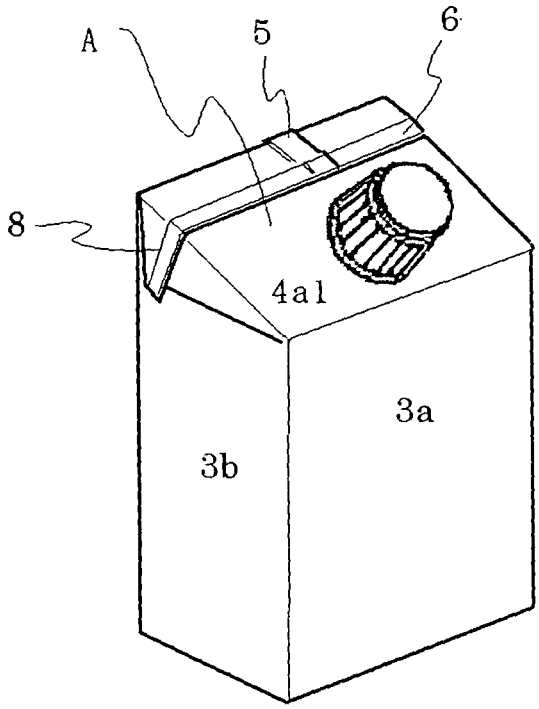
FIG. 9 is a perspective view of an embodiment of the container with a large-sized screw cap.

FIG. 9 shows a container example having a large-sized screw cap on the paper packaging container example of FIG. 2. The container of the embodiment comprises longitudinal seal 5. Transverse seal 6 is folded along a forward portion of the upper side.

Flap 8 formed during the forming of the top side is folded on the side wall faces of side panel 3*b*. The shed roof shape A is formed from the top panels 4*a*1, 4*a*2 and the transverse seal 6. The large-sized screw cap is attached to the top panel 4*a*1.

Figure 10:
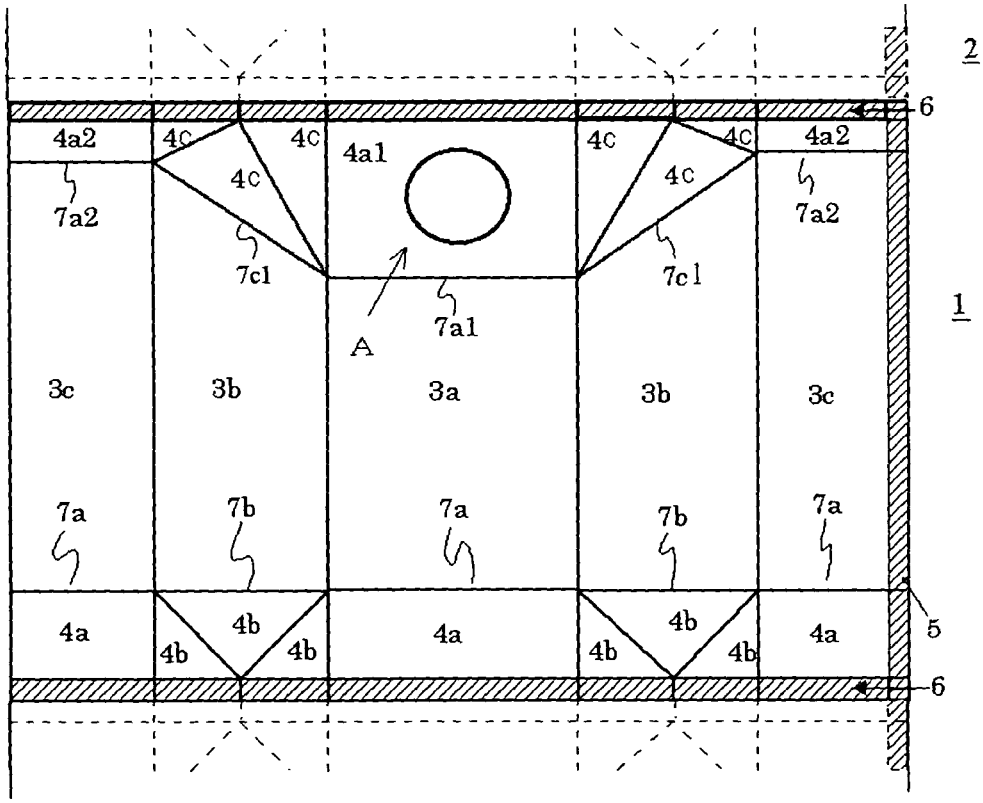
FIG. 10 is an outline development view of a paper packaging container shown in FIG. 7.

A front view of the packaging material used to form the spout embodiment is shown in FIG. 10. In the embodiment, an opening structure for spouts, a perforation, or pre-scoring lines can be formed in the top panel 4*a*1 of shed roof shape A. The structure is liquid-tight to the liquid contents so that the contents will not leak before the spout is applied to the top panel 4*a*1. Known alternative methods of applying a spout to the top panel can also be used.

The folding of panels that form the flaps occurs outwardly and is assisted by pushing on a part of the preliminary shape container to expand the flap panels outwardly such that the paper packaging container having a shed roof shape is formed without generating large stresses in the packaging material. Furthermore, the slanted top panel has a large area that allows a comparatively large-scale spout, an opening device, and/or a spout having a wide mouth to be attached. In comparison with a brick-shape container, a higher spout can be attached. A paper packaging container according to an embodiment of this invention also has a wider printing face on the front of the package. As a result, in a product showcase of a retail store, a container having greater customer attractive force can be provided.

The four corners of a container top can be subjected to outside damaging forces and effects in a distribution process. However, because two corners of a back side of the container produced according to an embodiment of the invention are protected by the slant folded flaps, container damage can be reduced. In addition, because two corners of the front side of the container are moved to a lower portion of a top of the container, the corners are unlikely to be exposed to the outside effects. The wider obtuse-angle of the corners also causes the stress to the container material to drop.

A container according to an embodiment of the invention can be formed at high speed with folding along the crease lines in existing packaging filling machines without using a special preliminary top crease formation apparatus.

Paper packaging containers according to embodiments of the invention are used in order to pack liquid foods such as milk, juice, refined sake, shochu, mineral water and other drinks.

The invention claimed is:

1. A method of manufacturing a paper packaging container comprises:

forming a web-shaped packaging material having crease lines into a tube with a longitudinal seal, filling contents in said tube-formed packaging material, forming said tube packaging material as a pillow-shaped preliminary shape container with a transverse seal in a transverse direction, cutting an individual preliminary shape container, forming a final shape container having a top, side walls and a bottom by folding said packaging material along said crease lines, wherein during said forming of the final shape, a body part of said preliminary shape container is pushed to inflate a part for said top and then said preliminary shape container is folded along said crease lines with flaps formed during forming of the top each being folded along an axis of slanted top ridgelines of said container on faces of said side walls to form said top as a shed roof shape.

2. A paper packaging container obtained from a tube formed by longitudinal sealing of web-shaped packaging material, filling of contents into said tube-formed packaging material, transverse sealing of said tube-formed packaging material in a transverse direction, forming of a pillow-shaped preliminary shape container, individual cutting of said preliminary pillow-shaped shape container and, forming of a final shape container having a top, side walls and a bottom by folding along crease lines, wherein flaps formed during forming of the top are folded outwardly and downwardly onto side wall faces, and said top is formed as a shed roof shape.

3. A paper packaging container according to claim 2, wherein said paper packaging container has a spout on said top.

4. A method of manufacturing a paper packaging container, comprising:

providing web-shaped packaging material with crease lines that define panels of a packaging container;

forming said web-shaped packaging material into a tube-shaped container by sealing said packaging material along a longitudinal seal;

filling contents into said tube-shaped container;

forming said tube-shaped container into a preliminary pillow-shape by forming a transverse seal in said packaging material;

cutting said tube-shaped container into one or more individual containers having said preliminary shape;

forming each of said one or more individual containers having a preliminary shape into a container having a final shape with a top, sides and a bottom by folding said packaging material along said crease lines, a part of said container being pushed to cause said packaging material in the top of said container to move outwardly along said crease lines, with flaps being formed by crease lines in the top of said container, and said flaps being folded outwardly and downwardly onto said sides of said container, with one of said crease lines in the top of said container along which a flap is folded forming a slanted ridgeline of the top of the container, with the top of the container being in the shape of a shed roof.

5. The method according to claim 4, wherein the bottom of said container is also formed by folding along crease lines and bottom flaps are formed by crease lines in the bottom of the container with the bottom flaps being folded onto a bottom face of the bottom of the container.

6. The method according to claim 4, wherein said part of said container that is pushed is a front side or a back side of said container.

7. The method according to claim 4, wherein said part of said container is pushed to cause the packaging material in the top of the container to move outwardly along the crease lines before the packaging material is folded along crease lines to form the bottom of the container.

8. The method according to claim 4, wherein said part of said container is pushed to cause the packaging material in the top of the container to move outwardly along said crease lines after bottom flaps formed by crease lines in the bottom of the container have been folded onto a bottom face of the container to form the bottom of the container.

9. A method of manufacturing a paper packaging container, comprising:

providing web-shaped packaging material with crease lines that define panels of a packaging container;

forming said web-shaped packaging material into a tube-shaped container by sealing said packaging material along a longitudinal seal;

filling contents into said tube-shaped container;

forming said tube-shaped container into a preliminary pillow-shape by forming a transverse seal in said packaging material;

cutting said tube-shaped container into one or more individual containers having said preliminary shape;

forming each of said one or more individual containers having a preliminary shape into a container having a final shape with a top panel, front panel, back panel, side panels, a bottom panel and top and bottom flaps, by folding said packaging material along said crease lines, a part of said container being pushed to cause said packaging material in a top of said container to move outwardly along said crease lines, with said top flaps being formed by crease lines on both sides of the top panel of said container, and said top flaps being folded outwardly and downwardly onto said side panels of said container such that said top panel is slanted at an angle greater than 90 degrees relative to said front panel, and said top flaps being adhered to said side panels of said container.

10. The method according to claim 9, wherein the part of said container that is pushed to cause said packaging material to move outwardly along said crease lines is the front panel of said container.

11. The method according to claim 9, wherein the bottom flaps are folded onto the bottom panel of the container to form the bottom of the container.

12. The method according to claim 11, wherein said part of said container is pushed to cause the packaging material in the top of said container to move outwardly along said crease lines before said bottom flaps are folded onto the bottom panel of the container to form the bottom of the container.

13. A paper packaging container, comprising:

a tube of web-shaped packaging material that is sealed along a longitudinal seal, filled with contents, sealed along a transverse seal, formed into a preliminary pillow-shape, cut into an individual container, and formed into a final shape having a top panel, front and back panels, side panels, a bottom panel and top and bottom flaps by folding the web-shaped packaging material along crease lines, said top flaps being folded outwardly and downwardly from said top panel and adhered to said side panels with the crease lines along which said top flaps are folded comprising slanted side edges of said top panel, and said top panel forms an angle greater than 90 degrees with said front panel.

14. The paper packaging container according to claim 13, wherein said bottom flaps are folded onto said bottom panel and adhered to said bottom panel to form the bottom of said container.

15. The paper packaging container according to claim 13, wherein said top flaps comprise 3 triangular-shaped panels on each side of said top panel.

16. The paper packaging container according to claim 13, wherein said packaging material is folded along said crease lines with said top flaps comprising triangular-shaped panels that extend outwardly from said top panel and downwardly over a portion of said side panels.

17. The paper packaging container according to claim 13, wherein a spout is formed in said top panel.

18. The paper packaging container according to claim 17, wherein said spout includes a screw cap.

19. The paper packaging container according to claim 17, wherein said spout includes a flip-type cap.

20. The paper packaging container according to claim 13, wherein said top flaps are folded down over said side panels and against back corner edges of said back panel.

* * * * *